US011833561B2

(12) United States Patent
Rowland

(10) Patent No.: US 11,833,561 B2
(45) **Date of Patent: *Dec. 5, 2023**

(54) METHOD OF MANUFACTURING A COILED TUBING STRING

(71) Applicant: FORUM US, INC., Houston, TX (US)

(72) Inventor: Raymond Rowland, Dayton, TX (US)

(73) Assignee: Forum US, Inc., Houston, TX (US)

( * ) Notice: Subject to any disclaimer, the term of this patent is extended or adjusted under 35 U.S.C. 154(b) by 352 days.

This patent is subject to a terminal disclaimer.

(21) Appl. No.: 16/571,748

(22) Filed: Sep. 16, 2019

(65) Prior Publication Data

US 2020/0009629 A1 Jan. 9, 2020

Related U.S. Application Data

(63) Continuation of application No. 15/407,855, filed on Jan. 17, 2017, now Pat. No. 10,434,554.

(51) Int. Cl.

| | |
|---|---|
| ***B21C 37/08*** | (2006.01) |
| ***B21C 37/30*** | (2006.01) |
| ***E21B 17/20*** | (2006.01) |
| ***C21D 8/10*** | (2006.01) |
| ***C21D 9/08*** | (2006.01) |
| ***C21D 9/50*** | (2006.01) |
| ***C21D 1/18*** | (2006.01) |

(52) U.S. Cl.

CPC ..... *B21C 37/08* (2013.01); *B21C 37/30* (2013.01); *C21D 1/18* (2013.01); *C21D 8/105* (2013.01); *C21D 9/08* (2013.01); *C21D 9/50* (2013.01); *E21B 17/20* (2013.01)

(58) Field of Classification Search

CPC ..... B21C 37/08; B21C 37/30

See application file for complete search history.

(56) References Cited

U.S. PATENT DOCUMENTS

| | | | |
|---|---|---|---|
| 2,982,312 | A | 5/1961 | Caplan et al. |
| 3,259,148 | A | 7/1966 | Krengel et al. |
| 3,316,395 | A | 4/1967 | Lavin |
| 3,316,396 | A | 4/1967 | Trott et al. |
| 3,325,174 | A | 6/1967 | Weaver |
| 3,362,731 | A | 1/1968 | Gasche et al. |
| 3,366,392 | A | 1/1968 | Kennel |
| 3,413,166 | A | 11/1968 | Zackay et al. |
| 3,489,437 | A | 1/1970 | Duret |
| 3,512,789 | A | 5/1970 | Tanner |
| 3,552,781 | A | 1/1971 | Helland |

(Continued)

FOREIGN PATENT DOCUMENTS

| | | |
|---|---|---|
| CA | 2414822 A1 | 6/2004 |
| CA | 2319926 C | 7/2008 |

(Continued)

OTHER PUBLICATIONS

Korea Office Action dated Sep. 8, 2020 for Application No. 10-2019-7023891.

(Continued)

*Primary Examiner* — Teresa M Ekiert

(74) *Attorney, Agent, or Firm* — PATTERSON & SHERIDAN, L.L.P.

(57) ABSTRACT

A method of manufacturing a coiled tubing string that meets specified material properties in a single continuous operation.

16 Claims, 2 Drawing Sheets

(56) References Cited

U.S. PATENT DOCUMENTS 3,572,777 A 3/1971 Blose et al.
3,575,430 A 4/1971 Alpine
3,592,491 A 7/1971 Glover
3,599,931 A 8/1971 Hanson
3,655,465 A 4/1972 Snape et al.
3,733,093 A 5/1973 Seiler
3,810,793 A 5/1974 Heller
3,854,760 A 12/1974 Duret
3,889,989 A 6/1975 Legris et al.
3,891,224 A 6/1975 Ditcher
3,893,919 A 7/1975 Flegel et al.
3,915,697 A 10/1975 Giuliani et al.
3,918,726 A 11/1975 Kramer
3,986,731 A 10/1976 De Hoff
4,014,568 A 3/1977 Carter et al.
4,147,368 A 4/1979 Baker et al.
4,163,290 A 7/1979 Sutherlin et al.
4,219,204 A 8/1980 Pippert
4,231,555 A 11/1980 Saito
4,299,412 A 11/1981 Parmann
4,305,059 A 12/1981 Benton
4,310,163 A 1/1982 Pippert
4,336,081 A 6/1982 Hijikata et al.
4,345,739 A 8/1982 Wheatley
4,354,882 A 10/1982 Greer
4,366,971 A 1/1983 Lula
4,368,894 A 1/1983 Parmann
4,373,750 A 2/1983 Mantelle et al.
4,376,528 A 3/1983 Ohshimatani et al.
4,379,482 A 4/1983 Suzuki et al.
4,384,737 A 5/1983 Reusser
4,406,561 A 9/1983 Ewing
4,407,681 A 10/1983 Ina et al.
4,426,095 A 1/1984 Buttner
4,445,265 A 5/1984 Olson et al.
4,473,471 A 9/1984 Robichaud et al.
4,475,839 A 10/1984 Strandberg
4,491,725 A 1/1985 Pritchard
4,506,432 A 3/1985 Smith
4,526,628 A 7/1985 Ohno et al.
4,527,815 A 7/1985 Smith
4,564,392 A 1/1986 Tateo et al.
4,570,982 A 2/1986 Blose et al.
4,591,195 A 5/1986 Chelette et al.
4,592,558 A 6/1986 Hopkins
4,601,491 A 7/1986 Bell, Jr. et al.
4,602,807 A 7/1986 Bowers
4,623,173 A 11/1986 Handa et al.
4,629,218 A 12/1986 Dubois
4,662,659 A 5/1987 Blose et al.
4,674,756 A 6/1987 Fallon et al.
4,688,832 A 8/1987 Ortloff et al.
4,706,997 A 11/1987 Carstensen
4,710,245 A 12/1987 Roether
4,721,536 A 1/1988 Koch et al.
4,758,025 A 7/1988 Frick
4,762,344 A 8/1988 Perkins et al.
4,812,182 A 3/1989 Fang et al.
4,814,141 A 3/1989 Imai et al.
4,844,517 A 7/1989 Beiley et al.
4,856,828 A 8/1989 Kessler et al.
4,863,091 A 9/1989 Dubois
4,955,645 A 9/1990 Weems
4,958,862 A 9/1990 Cappelli et al.
4,988,127 A 1/1991 Cartensen
5,007,665 A 4/1991 Bovisio et al.
5,067,874 A 11/1991 Foote
5,137,310 A 8/1992 Noel et al.
5,143,381 A 9/1992 Temple
5,154,534 A 10/1992 Guerin et al.
5,180,008 A 1/1993 Aldridge et al.
5,191,911 A 3/1993 Dubois
5,242,199 A 9/1993 Hann et al.
5,328,158 A 7/1994 Lewis et al.
5,348,350 A 9/1994 Blose et al.
5,352,406 A 10/1994 Barteri et al.
5,360,239 A 11/1994 Klementich
5,449,420 A 9/1995 Okada et al.
5,454,883 A 10/1995 Yoshie et al.
5,456,405 A 10/1995 Stagg
5,505,502 A 4/1996 Smith et al.
5,515,707 A 5/1996 Smith
5,538,566 A 7/1996 Gallagher
5,592,988 A 1/1997 Meroni et al.
5,598,735 A 2/1997 Saito et al.
5,653,452 A 8/1997 Jarvenkyla
5,712,706 A 1/1998 Castore et al.
5,794,985 A 8/1998 Mallis
5,810,401 A 9/1998 Mosing et al.
5,860,680 A 1/1999 Drijver et al.
5,879,030 A 3/1999 Clayson et al.
5,879,474 A 3/1999 Bhadeshia et al.
5,944,921 A 8/1999 Cumino et al.
5,993,570 A 11/1999 Gray
6,006,789 A 12/1999 Toyooka et al.
6,030,470 A 2/2000 Hensger et al.
6,044,539 A 4/2000 Guzowksi
6,045,165 A 4/2000 Sugino et al.
6,056,324 A 5/2000 Reimert et al.
6,070,912 A 6/2000 Atham
6,173,968 B1 1/2001 Nelson et al.
6,188,037 B1 2/2001 Hamada et al.
6,196,530 B1 3/2001 Muhr et al.
6,217,676 B1 4/2001 Takabe et al.
6,248,187 B1 6/2001 Asahi et al.
6,257,056 B1 7/2001 Shibayama et al.
6,267,828 B1 7/2001 Kushida et al.
6,311,965 B1 11/2001 Muhr et al.
6,331,216 B1 12/2001 Toyooka et al.
6,347,814 B1 2/2002 Cerruti
6,349,979 B1 2/2002 Noel et al.
6,358,336 B1 3/2002 Miyata
6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.
6,494,499 B1 12/2002 Galle, Sr. et al.
6,514,359 B2 2/2003 Kawano
6,527,056 B2 3/2003 Newman
6,540,848 B2 4/2003 Miyata et al.
6,550,822 B2 4/2003 Mannella et al.
6,557,906 B1 5/2003 Carcagno
6,558,484 B1 5/2003 Onoe et al.
6,581,940 B2 6/2003 Dittel
6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Marotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura
7,083,686 B2 8/2006 Itou
7,108,063 B2 9/2006 Carstensen
7,118,637 B2 10/2006 Kusinski et al.
7,182,140 B2 2/2007 Wood
7,214,278 B2 5/2007 Kusinski et al.
7,255,374 B2 8/2007 Carcagno et al.

(56) References Cited

U.S. PATENT DOCUMENTS 7,264,684 B2 9/2007 Numata et al.
7,284,770 B2 10/2007 Dell'erba et al.
7,310,867 B2 12/2007 Corbett, Jr.
7,431,347 B2 10/2008 Ernst et al.
7,464,449 B2 12/2008 Santi et al.
7,475,476 B2 1/2009 Roussie
7,478,842 B2 1/2009 Reynolds, Jr. et al.
7,506,900 B2 3/2009 Carcagno et al.
7,621,034 B2 11/2009 Roussie
7,635,406 B2 12/2009 Numata et al.
7,735,879 B2 6/2010 Toscano et al.
7,744,708 B2 6/2010 Lopez et al.
7,753,416 B2 7/2010 Mazzaferro et al.
7,862,667 B2 1/2011 Turconi et al.
8,002,910 B2 8/2011 Tivelli et al.
8,007,601 B2 8/2011 Lopez et al.
8,007,603 B2 8/2011 Garcia et al.
8,016,362 B2 9/2011 Itoga
8,262,094 B2 9/2012 Beele
8,262,140 B2 9/2012 Santi et al.
8,317,946 B2 11/2012 Arai et al.
8,328,958 B2 12/2012 Turconi et al.
8,328,960 B2 12/2012 Gomez et al.
8,333,409 B2 12/2012 Santi et al.
8,414,715 B2 4/2013 Altschuler et al.
8,544,304 B2 10/2013 Santi
8,636,856 B2 1/2014 Altschuler
8,821,653 B2 9/2014 Anelli et al.
8,840,152 B2 9/2014 Carcagno et al.
8,926,771 B2 1/2015 Agazzi et al.
9,004,544 B2 4/2015 Carcagno et al.
9,163,296 B2 10/2015 Valdez et al.
9,187,811 B2 11/2015 Gomez et al.
9,222,156 B2 12/2015 Altschuler et al.
9,234,612 B2 1/2016 Santi et al.
9,340,847 B2 5/2016 Altschuler et al.
9,383,045 B2 7/2016 Santi et al.
9,528,327 B1 12/2016 Lux
9,541,224 B2 1/2017 Rowland et al.
9,598,746 B2 3/2017 Anelli et al.
9,708,681 B2 7/2017 Eguchi et al.
9,745,640 B2 8/2017 Valdez et al.
9,803,256 B2 10/2017 Valdez et al.
11,377,704 B2 7/2022 Valdez et al.
2001/0035235 A1 11/2001 Kawano
2002/0011284 A1 1/2002 Von Hagen et al.
2002/0153671 A1 10/2002 Raymond et al.
2002/0158469 A1 10/2002 Mannella et al.
2003/0019549 A1 1/2003 Turconi et al.
2003/0111146 A1 6/2003 Kusinski et al.
2003/0116238 A1 6/2003 Fujita
2003/0155052 A1 8/2003 Kondo et al.
2003/0165098 A1 9/2003 Ohara et al.
2003/0168859 A1 9/2003 Watts
2004/0118490 A1 6/2004 Klueh et al.
2004/0118569 A1 6/2004 Brill et al.
2004/0131876 A1 7/2004 Ohgami et al.
2004/0139780 A1 7/2004 Cai et al.
2004/0187971 A1 9/2004 Omura
2004/0195835 A1 10/2004 Noel et al.
2004/0262919 A1 12/2004 Dutilleul et al.
2005/0012278 A1 1/2005 Delange
2005/0076975 A1 4/2005 Lopez et al.
2005/0087269 A1 4/2005 Merwin
2005/0093250 A1 5/2005 Santi et al.
2005/0166986 A1 8/2005 Dell'erba et al.
2006/0006600 A1 1/2006 Roussie
2006/0124211 A1 6/2006 Takano et al.
2006/0137781 A1 6/2006 Kusinski et al.
2006/0157539 A1 7/2006 DuBois
2006/0169368 A1 8/2006 Lopez et al.
2006/0231168 A1 10/2006 Nakamura et al.
2006/0231186 A1 10/2006 Nakmura et al.
2006/0243355 A1 11/2006 Haiderer et al.
2006/0273586 A1 12/2006 Reynolds et al.
2007/0039147 A1 2/2007 Roussie
2007/0039149 A1 2/2007 Roussie
2007/0089813 A1 4/2007 Tivelli
2007/0137736 A1 6/2007 Omura et al.
2007/0216126 A1 9/2007 Lopez et al.
2007/0246219 A1 10/2007 Manella et al.
2008/0047635 A1 2/2008 Kanda et al.
2008/0115863 A1 5/2008 McCrink et al.
2008/0129044 A1 6/2008 Carcagno et al.
2008/0219878 A1 9/2008 Kanda et al.
2008/0226396 A1 9/2008 Garcia et al.
2008/0226491 A1 9/2008 Satou et al.
2008/0257459 A1 10/2008 Arai et al.
2008/0264129 A1 10/2008 Cheppe et al.
2008/0286504 A1 11/2008 Asahi et al.
2008/0303274 A1 12/2008 Mazzaferro et al.
2008/0314481 A1 12/2008 Garcia et al.
2009/0010794 A1 1/2009 Turconi et al.
2009/0033087 A1 2/2009 Carcagno et al.
2009/0047166 A1 2/2009 Tomomatsu et al.
2009/0101242 A1 4/2009 Lopez et al.
2009/0114318 A1 5/2009 Arai et al.
2009/0226491 A1 9/2009 Satou et al.
2009/0226988 A1 9/2009 Tajima et al.
2010/0136363 A1 6/2010 Valdez et al.
2010/0187808 A1 7/2010 Santi
2010/0193085 A1 8/2010 Garcia
2010/0206553 A1 8/2010 Bailey et al.
2010/0294401 A1 11/2010 Gomez
2010/0319814 A1 12/2010 Perez
2010/0327550 A1 12/2010 Lopez
2011/0042946 A1 2/2011 Santi
2011/0077089 A1 3/2011 Hirai et al.
2011/0097235 A1 4/2011 Turconi et al.
2011/0133449 A1 6/2011 Mazzaferro
2011/0233925 A1 9/2011 Pina
2011/0247733 A1 10/2011 Arai et al.
2011/0259482 A1 10/2011 Peters et al.
2011/0284137 A1 11/2011 Kami et al.
2012/0018056 A1 1/2012 Nakagawa et al.
2012/0186686 A1 7/2012 Valdez
2012/0199255 A1 8/2012 Anelli
2012/0267014 A1 10/2012 Hitoshio et al.
2013/0000790 A1 1/2013 Arai et al.
2013/0004787 A1 1/2013 Ishiyama et al.
2013/0199674 A1 8/2013 Altschuler et al.
2013/0264123 A1 10/2013 Altschuler et al.
2014/0021244 A1 1/2014 DuBois
2014/0027497 A1 1/2014 Rowland et al.
2014/0057121 A1 2/2014 Altschuler et al.
2014/0137992 A1 5/2014 Ishiguro et al.
2014/0251512 A1 9/2014 Gomez
2014/0272448 A1* 9/2014 Valdez ..... C21D 9/14
428/592
2014/0299235 A1 10/2014 Anelli
2014/0299236 A1 10/2014 Anelli
2015/0368986 A1 12/2015 Narikawa
2016/0024625 A1 1/2016 Valdez
2016/0033059 A1* 2/2016 Fonte ..... B21C 37/0815
72/368
2016/0102856 A1 4/2016 Minami
2016/0281188 A1 9/2016 Valdez et al.
2016/0305192 A1 10/2016 Buhler
2018/0044747 A1 2/2018 Valdez et al.
2018/0051353 A1 2/2018 Valdez et al.
2020/0181730 A1 6/2020 Duan

FOREIGN PATENT DOCUMENTS

CN 1401809 A 3/2003
CN 1487112 A 4/2004
CN 1292429 C 12/2006
CN 101403450 A 4/2009
CN 101480671 A 7/2009
CN 101542002 A 9/2009
CN 101613829 A 12/2009
CN 101413089 B 11/2010
CN 101898295 A 12/2010
CN 102618709 A 8/2012

(56) References Cited

FOREIGN PATENT DOCUMENTS

| | | | |
|---|---|---|---|
| DE | 3310226 | A1 | 10/1984 |
| DE | 4446806 | C1 | 5/1996 |
| EA | 010037 | B1 | 6/2008 |
| EA | 012256 | B1 | 8/2009 |
| EP | 0032265 | A1 | 7/1981 |
| EP | 0092815 | A2 | 11/1983 |
| EP | 0104720 | A1 | 4/1984 |
| EP | 0159385 | A1 | 10/1985 |
| EP | 0309179 | A1 | 3/1989 |
| EP | 0340385 | A2 | 11/1989 |
| EP | 0329990 | B1 | 11/1992 |
| EP | 0658632 | A1 | 6/1995 |
| EP | 0753595 | A2 | 1/1997 |
| EP | 0788850 | A1 | 8/1997 |
| EP | 0828007 | A1 | 3/1998 |
| EP | 0989196 | A1 | 3/2000 |
| EP | 1008660 | A1 | 6/2000 |
| EP | 1065423 | A2 | 1/2001 |
| EP | 1277848 | A1 | 1/2003 |
| EP | 1288316 | A1 | 3/2003 |
| EP | 1296088 | A1 | 3/2003 |
| EP | 1362977 | A2 | 11/2003 |
| EP | 1413639 | A1 | 4/2004 |
| EP | 1182268 | B1 | 9/2004 |
| EP | 1705415 | A2 | 9/2006 |
| EP | 1726861 | A1 | 11/2006 |
| EP | 1876254 | A1 | 1/2008 |
| EP | 1914324 | A1 | 4/2008 |
| EP | 2000629 | A1 | 12/2008 |
| EP | 2028284 | A1 | 2/2009 |
| EP | 2133442 | A1 | 12/2009 |
| EP | 2216576 | A1 | 8/2010 |
| EP | 2239343 | A1 | 10/2010 |
| EP | 2447386 | A1 | 5/2012 |
| EP | 2729590 | B1 | 10/2015 |
| EP | 3072981 | A1 | 9/2016 |
| ER | 1149513 | A | 12/1957 |
| FR | 1489013 | A | 7/1967 |
| FR | 2704042 | A1 | 10/1994 |
| JP | S56133427 | A | 10/1981 |
| JP | S5819439 | A | 2/1983 |
| JP | H020305929 | A | 12/1990 |
| JP | H09201688 | | 8/1997 |
| JP | 10-280037 | | 10/1998 |
| JP | 2000178645 | A | 6/2000 |
| JP | 2003321713 | A | 11/2003 |
| JP | 2010274285 | A | 12/2010 |
| RU | 2120365 | C1 | 10/1998 |
| RU | 2321483 | C2 | 4/2008 |
| RU | 2578291 | C2 | 3/2016 |
| SU | 661290 | A1 | 5/1979 |
| WO | 2001075345 | A1 | 10/2001 |

OTHER PUBLICATIONS

International Search and Written Opinion dated Apr. 4, 2018, corresponding to Application No. PCT/US2018/013988.

Korean Office Action dated Mar. 23, 2021, for Korean Patent Application No. 10-2019-7023891.

Korean Office Action dated Mar. 30, 2021, for Korean Patent Application No. 10-2020-7032372.

Human Resources Development Service of Korea—"Metal Heat Treatment Practice," Dec. 26, 2014, 10 pages.

Saudi Arabian First Substantive Examination Report dated Sep. 7, 2021, for Saudi Arabian Patent Application No. 519402300.

English translation of Chinese Patent No. 1873041A, Dec. 6, 2006, served by Global Tubing, LLC on Apr. 12, 2021 as Nos. Gtoo 11821-GTOO 11827 in *Global Tubing, LLC* vs. *Tenaris Coiled Tubes, LLC et al.*, case No. 4:17-cv-03299 in the United States District Court for the Southern District of Texas, Houston Division, 7 pages.

English translation of Chinese Publication No. 101602079 B, May 4, 2011, served by Global Tubing, LLC on Apr. 12, 2021 as Nos. GT0025109-GT0025131 in *Global Tubing, LLC* vs. *Tenaris Coiled Tubes, LLC et al.*, case No. 4:17-cv-03299 in the United States District Court for the Southern District of Texas, Houston Division, 23 pages.

English translation of Chinese Publication No. CN 101898295 A, Dec. 1, 2010, served by Global Tubing, LLC on Apr. 12, 2021 as Nos. GT0283198-GT0283211 in *Global Tubing, LLC* vs. *Tenaris Coiled Tubes, LLC et al.*, case No. 4:17-cv-03299 in the United States District Court for the Southern District of Texas, Houston Division, 14 pages.

English translation of Japanese Patent Publication No. H09-201688, Aug. 5, 1997, served by Global Tubing, LLC on Apr. 12, 2021 as Nos. GT0025731-GT0025748 in *Global Tubing, LLC* vs. *Tenaris Coiled Tubes, LLC et al.*, case No. 4:17-cv-03299 in the United States District Court for the Southern District of Texas, Houston Division, 18 pages.

English translation of Japanese Publication No. 2000-282144, Oct. 10, 2000, served by Global Tubing, LLC on Apr. 12. 2021 as Nos. GT0025063-GT0025073 in *Global Tubing, LLC* vs. *Tenaris Coiled Tubes, LLC et al.*, case No. 4:17-cv-03299 in the United States District Court for the Southern District of Texas, Houston Division, 11 pages.

English translation of Japanese Publication No. H06-116645, Apr. 26, 1994, served by Global Tubing, LLC on Apr. 12, 2021 as Nos. GT0025707-GT0025730 in *Global Tubing, LLC* vs. *Tenaris Coiled Tubes, LLC et al.*, case No. 4:17-cv-03299 in the United States District Court for the Southern District of Texas, Houston Division, 24 pages.

English translation of Japanese Publication No. S58-19439, Feb. 2, 1983, served by Global Tubing, LLC on Apr. 12, 2021 as Nos. GT0025074-GT0025083 in *Global Tubing, LLC* vs. *Tenaris Coiled Tubes, LLC et al.*, case No. 4:17-cv-03299 in the United States District Court for the Southern District of Texas, Houston Division, 10 pages.

Exhibit A-1 Identification of Asserted Claims and Limitations Therein, U.S. Pat. No. 9,803,256, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 19 pages, 4 pages.

Exhibit A-2 U.S. Pat. No. 9,803,256, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 19 pages, 30 pages.

Exhibit A-3 Altschuler 715, served by Global Tubing, LLC on Apr. 12, 2021 (and referring to a document beginning with p. GTOO11425) in *Global Tubing, LLC* vs. *Tenaris Coiled Tubes, LLC et al.*, case No. 4:17-cv-03299 in the United States District Court for the Southern District of Texas, Houston Division, 19 pages.

Exhibit A-3 Altschuler 856, served by Global Tubing, LLC on Apr. 12, 2021 (and referring to a document beginning with p. GTOO 11442) in *Global Tubing, LLC* vs. *Tenaris Coiled Tubes, LLC et al.*, case No. 4:17-cv-03299 in the United States District Court for the Southern District of Texas, Houston Division, 17 pages.

Exhibit A-3 Api Specification, American Petroleum Institute, Specification for Coiled Tubing, API Specification 5ST, served by Global Tubing, LLC on Apr. 12, 2021 (and referring to a document beginning with p. GT0224055) in *Global Tubing, LLC* vs. *Tenaris Coiled Tubes, LLC et al.*, case No. 4:17-cv-03299 in the United States District Court for the Southern District of Texas, Houston Division, 13 pages.

Exhibit A-3 Asano (Supplemental), served by Global Tubing, LLC on Apr. 12, 2021 (and referring to documents beginning with p. GTOO 11542 and GTOO 11547) in *Global Tubing, LLC* vs. *Tenaris Coiled Tubes, LLC et al.*, case No. 4:17-cv-03299 in the United States District Court for the Southern District of Texas, Houston Division, 18 pages.

Exhibit A-3 Chitwood, High Strength Coiled Tubing Expands Service Capabilities, served by Global Tubing on Apr. 12, 2021 (and referring to a document beginning with p. GT0023898 and ending with page GT0023913) in *Global Tubing, LLC* vs. *Tenaris Coiled*

(56) References Cited

OTHER PUBLICATIONS

*Tubes, LLC et al.*, case No. 4:17-cv-03299 in the United States District Court for the Southern District of Texas, Houston Division, 28 pages.
Exhibit A-3 Crowther, served by Global Tubing, LLC on Apr. 12, 2021 (and referring to a document beginning with p. GT0012789) in *Global Tubing, LLC* vs. *Tenaris Coiled Tubes, LLC et al.*,case No. 4:17-cv-03299 in the United States District Court for the Southern District of Texas, Houston Division, 23 pages.
Exhibit A-3 C Manual (Supplemental), Coiled Tubing Manual, served by Global Tubing, LLC on Apr. 12, 2021 (and referring to a document beginning with p. GT0011855) in *Global Tubing, LLC* vs. *Tenaris Coiled Tubes, LLC et al.*, case No. 4:17-cv-03299 in the United States District Court for the Southern District of Texas, Houston Division, 15 pages.
Exhibit A-3 Cymax 100, served by Global Tubing, LLC on Apr. 12, 2021 in *Global Tubing, LLC* vs. *Tenaris Coiled Tubes, LLC et al.*, case No. 4:17-cv-03299 in the United States District of Texas, Houston Division, 22 pages.
Exhibit A-3 Cymax Brochure, served by Global Tubing, LLC on Apr. 12, 2021 (and referring to a document labeled with pp. TCT0009950-89) in *Global Tubing, LLC* vs. *Tenaris Coiled Tubes, LLC et al.*, case No. 4:17-cv-03299 in the United States District Court for the Southern District of Texas, Houston Division, 21 pages.
Exhibit A-3 Eguchi 2012, served by Global Tubing, LLC on Apr. 12, 2021 (and referring to a document beginning with p. GTOO 12879) in *Global Tubing, LLC* vs. *Tenaris Coiled Tubes, LLC et al.*, case No. 4:17-cv-03299 in the United States District Court for the Southern District of Texas, Houston Division, 24 pages.
Exhibit A-3 Eguchi 681, served by Global Tubing, LLC on Apr. 12, 2021 (and referring to a document beginning with p. GTOO12866 and ending with p. GTOO12878) in *Global Tubing, LLC* vs. *Tenaris Coiled Tubes, LLC et al.*, case No. 4:17-cv-03299 in the United States District Court for the Southern District of Texas, Houston Division, 26 pages.
Exhibit A-3 Feng, served by Global Tubing, LLC on Apr. 12, 2021 (and referring to a document beginning with p. GT0283198) in *Global Tubing, LLC* vs. *Tenaris Coiled Tubes, LLC et al.*, case No. 4:17-cv-03299 in the United States District Court for the Southern District of Texas, Houston Division, 15 pages.
Exhibit A-3 Fujishiro, served by Global Tubing, LLC on Apr. 12, 2021 (and referring to a document beginning with p. GT0025074 and ending with p. GT0025083) in *Global Tubing, LLC* vs. *Tenaris Coiled Tubes, LLC et al.*, case No. 4:17-cv-03299 in the United States District Court for the Southern District of Texas, Houston Division, 21 pages.
Exhibit A-3 Kushida, served by Global Tubing, LLC on Apr. 12, 2021 (and referring to a document beginning with p. GT0012967) in *Global Tubing, LLC* vs. *Tenaris Coiled Tubes, LLC et al.*, case No. 4:17-cv-03299 in the United States District Court for the Southern District of Texas, Houston Division, 22 pages.
Exhibit A-3 O'Hara, served by Global Tubing, LLC on Apr. 12, 2021 (and referring to a document beginning with p. GT0025287) in *Global Tubing, LLC* vs. *Tenaris Coiled Tubes, LLC et al.*, case No. 4:17-cv-03299 in the United States District Court for the Southern District of Texas, Houston Division, 14 pages.
Exhibit A-3 Peters, served by Global Tubing, LLC on Apr. 12, 2021 (and referring to a document beginning with p. GT0013047) in *Global Tubing, LLC* vs. *Tenaris Coiled Tubes, LLC et al.*, case No. 4:17-cv-03299 in the United States District Court for the Southern District of Texas, Houston Division, 20 pages.
Exhibit A-3 Satou, served by Global Tubing, LLC on Apr. 12, 2021 (and referring to a document beginning with p. GT0025646) in *Global Tubing, LLC* vs. *Tenaris Coiled Tubes, LLC et al.*, case No. 4:17-cv-03299 in the United States District Court for the Southern District of Texas, Houston Division, 17 pages.
Exhibit A-3 SeaCAT 100, served by Global Tubing, LLC on Apr. 12, 2021 (and referring to documents beginning with p. TCT0374366, GT0210506, TCT0373809, TCT0372631, GT0011295, TCT0372486, TCT0375105, TCT03727329-TCT0374535) in *Global Tubing, LLC* vs. *Tenaris Coiled Tubes, LLC et al.*, case No. 4:17-cv-03299 in the United States District Court for the Southern District of Texas, Houston Division, 16 pages.
Exhibit A-3 SeaCAT Specification, served by Global Tubing, LLC on Apr. 12, 2021 (and referring to a document beginning with p. GT0210506) in *Global Tubing, LLC* vs. *Tenaris Coiled Tubes, LLC et al.*, case No. 4:17-cv-03299 In the United States District Court for the Southern District of Texas, Houston Division, 12 pages.
Exhibit A-3 Takeshi, served by Global Tubing, LLC on Apr. 12, 2021 (and referring to a document beginning with p. GT0025731) in *Global Tubing, LLC* vs. *Tenaris Coiled Tubes, LLC et al.*, case No. 4:17-cv-03299 in the United States District Court for the Southern District of Texas, Houston Division, 17 pages.
Exhibit A-3 Thompson, served by Global Tubing, LLC on Apr. 12, 2021 (and referring to a document labeled with pp. TCT0009930-49) in *Global Tubing, LLC* vs. *Tenaris Coiled Tubes, LLC et al.*, case No. 4:17-cv-03299 in the United States District Court for the Southern District of Texas, Houston Division, 21 pages.
Exhibit A-3 Turconi 2001, served by Global Tubing, LLC on Apr. 12, 2021 (and referring to a document beginning with p. GT0025769) in *Global Tubing, LLC* vs. *Tenaris Coiled Tubes, LLC et al.*, case No. 4:17-cv-03299 in the United States District Court for the Southern District of Texas, Houston Division, 19 pages.
Exhibit A-3 Turconi, served by Global Tubing, LLC on Apr. 12, 2021 (and referring to a document beginning with p. GT0011237) in *Global Tubing, LLC* vs. *Tenaris Coiled Tubes, LLC et al.*, case No. 4:17-cv-03299 in the United States District Court for the Southern District of Texas, Houston Division, 22 pages.
Exhibit A-3 Williams, served by Global Tubing, LLC on Apr. 12, 2021 (and referring to a document beginning with p. GT0011295) in *Global Tubing, LLC* vs. *Tenaris Coiled Tubes, LLC et al.*, case No. 4:17-cv-03299 in the United States District Court for the Southern District of Texas, Houston Division, 13 pages.
Exhibit A-3 Zemick, served by Global Tubing, LLC on Apr. 12, 2021 (and referring to a document beginning with p. GT0011300) in *Global Tubing, LLC* vs. *Tenaris Coiled Tubes, LLC et al.*, case No. 4:17-cv-03299 in the United States District Court for the Southern District of Texas, Houston Division, 18 pages.
Exhibit B-1, Identification of Asserted Claims and Limitations Therein, U.S. Pat. No. 10,378,074, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 4 pages.
Exhibit B-2, U.S. Pat. No. 10,378,074, 28 pages with Exhibit B-3 Attachments totaling 233 pages, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division.
Exhibit B-3 Altschuler 715, served by Global Tubing, LLC on Apr. 12, 2021 (and referring to a document beginning with p. GTOO11425) in *Global Tubing, LLC* vs. *Tenaris Coiled Tubes, LLC et al.*, case No. 4:17-cv-03299 in the United States District Court for the Southern District of Texas, Houston Division, 9 pages.
Exhibit B-3 Altschuler 856, served by Global Tubing, LLC on Apr. 12, 2021 (and referring to a document beginning with p. GTOO 11442) in *Global Tubing, LLC* vs. *Tenaris Coiled Tubes, LLC et al.*, case No. 4:17-cv-03299 in the United States District Court for the Southern District of Texas, Houston Division, 8 pages.
Exhibit B-3 Chitwood, High Strength Coiled Tubing Expands Service Capabilities, served by Global Tubing on Apr. 12, 2021 (and referring to a document beginning with p. GT0023898 and ending with p. GT0023913) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Crowther, served by Global Tubing, LLC on Apr. 12, 2021 (and referring to a document beginning with p. GT0012789) in *Global Tubing, LLC* vs. *Tenaris Coiled Tubes, LLC et al.*, case No. 4:17-cv-03299 in the United States District Court for the Southern District of Texas, Houston Division, 10 pages.
Exhibit B-3 CT Manual (Supplemental), Coiled Tubing Manual, served by Global Tubing, LLC on Apr. 12, 2021 (and referring to a

(56) References Cited

OTHER PUBLICATIONS document beginning with p. GT0011855) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Eguchi 681, served by Global Tubing, LLC on Apr. 12, 2021 (and referring to a document beginning with p. GTOO 12866 and ending with p. GTOO 12878) in *Global Tubing, LLC* vs. *Tenaris Coiled Tubes, LLC et al.*, case No. 4:17-cv-03299 in the United States District Court for the Southern District of Texas, Houston Divisionl 1 pages.
Exhibit B-3 Feng, served in Global Tubing, LLC on Apr. 12, 2021 (and referring to a document beginning with p. GT0283198) in *Global Tubing, LLC* vs. *Tenaris Coiled Tubes, LLC et al.*, case No. 4:17-cv-03299 in the United States District Court for the Southern District of Texas, Houston DivisionIO pages.
Exhibit B-3 Fujishiro, served in Global Tubing, LLC on Apr. 12, 2021 (and referring to a document beginning with p. GT0025074 and ending with p. GT0025083) in *Global Tubing, LLC* vs. *Tenaris Coiled Tubes, LLC et al.*, case No. 4:17-cv-03299 in the United States District Court for the Southern District of Texas, Houston Division, 10 pages.
Exhibit B-3 Kushida, served in Global Tubing, LLC on Apr. 12, 2021 (and referring to a document beginning with p. GT0012967) in *Global Tubing, LLC* vs. *Tenaris Coiled Tubes, LLC et al.*, case No. 4:17-cv-03299 in the United States District Court for the Southern District of Texas, Houston Division, 13 pages.
Exhibit B-3 O'Hara, served by Global Tubing, LLC on Apr. 12, 2021 (and referring to a document beginning with p. GT0025287) in *Global Tubing, LLC* vs. *Tenaris Coiled Tubes, LLC et al.*, case No. 4:17-cv-03299 in the United States District Court for the Southern District of Texas, Houston Division, 6 pages.
Exhibit B-3 Peters, served by Global Tubing, LLC on Apr. 12, 2021 (and referring to a document beginning with p. GT0013047) in *Global Tubing, LLC* vs. *Tenaris Coiled Tubes, LLC et al.*, case No. 4:17-cv-03299 in the United States District Court for the Southern District of Texas, Houston Division, 19 pages.
Exhibit B-3 Satou, served by Global Tubing, LLC on Apr. 12, 2021 (and referring to a document beginning with p. GT0025646) in *Global Tubing, LLC* vs. *Tenaris Coiled Tubes, LLC et al.*, case No. 4:17-cv-03299 in the United States District Court for the Southern District of Texas, Houston Division, 9 pages.
Exhibit B-3 SeaCAT 100, served by Global Tubing, LLC on Apr. 12, 2021 (and referring to documents beginning with p. TCT0374366, GT0210506, TCT0373809, TCT0372631, GT0011295, TCT0372486, TCT0375105, TCT0372730, TCT0374535) in *Global Tubing, LLC* vs. *Tenaris Coiled Tubes, LLC et al.*, case No. 4:17-cv-03299 in the United States District Court for the Southern District of Texas, Houston Division, 8 pages.
Exhibit B-3 Takeshi, served by Global Tubing, LLC on Apr. 12, 2021 (and referring to a document beginning with p. GT0025731) in *Global Tubing, LLC* vs. *Tenaris Coiled Tubes, LLC et al.*, case No. 4:17-cv-03299 in the United States District Court for the Southern District of Texas, Houston Division, 8 pages.
Exhibit B-3 Thompson, served by Global Tubing, LLC on Apr. 12, 2021 (and referring to a document labeled with pp. TCT0009930-49) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Turconi 2001, served by Global Tubing, LLC on Apr. 12, 2021 (and referring to a document beginning with p. GT0025769) in *Global Tubing, LLC* vs. *Tenaris Coiled Tubes, LLC et al.*, case No. 4:17-cv-03299 in the United States District Court for the Southern District of Texas, Houston Division, 11 pages.
Exhibit B-3 Turconi, served by Global Tubing, LLC on Apr. 12, 2021 (and referring to a document beginning with p. GT0011237) in *Global Tubing, LLC* vs. *Tenaris Coiled Tubes, LLC et al.*, case No. 4:17-cv-03299 in the United States District Court for the Southern District of Texas, Houston Division, 11 pages.
Exhibit B-3 Valdez 2010, served by Global Tubing, LLC on Apr. 12, 2021 (and referring to a document beginning with p. GTOO11261) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Williams, served by Global Tubing, LLC on Apr. 12, 2021 (and referring to a document beginning with p. GT0011295) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit B-3 Zemick, served by Global Tubing, LLC on Apr. 12, 2021 (and referring to a document beginning with p. GT0011300) in *Global Tubing, LLC* vs. *Tenaris Coiled Tubes, LLC et al.*, case No. 4:17-cv-03299 in the United States District Court for the Southern District of Texas, Houston Division, 7 pages.
Exhibit C-1, Identification of Asserted Claims and Limitations Therein, U.S. Pat. No. 10,378,075, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 4 pages.
Exhibit C-2, U.S. Pat. No. 10,378,075, served by Global Tubing, LLC on Apr. 12, 2021 in *Global Tubing, LLC* vs. *Tenaris Coiled Tubes, LLC et al.*, case No. 4:17-cv-03299 in the United States District Court for the Southern District of Texas, Houston Division, 6 pages with Exhibit C-3 Attachments totaling 260 pages.
Exhibit C-3 Altschuler 715, served by Global Tubing, LLC on Apr. 12, 2021 (and referring to a document beginning with p. GTOO 11425) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Altschuler 856, served by Global Tubing, LLC on Apr. 12, 2021 (and referring to a document beginning with page GTOO 11442) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Api Specification, American Petroleum Institute, Specification for Coiled Tubing, API Specification 5ST, served by Global Tubing, LLC on Apr. 12, 2021 (and referring to a document beginning with No. GT0224055) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Asano (Supplemental), served by Global Tubing, LLC on Apr. 12, 2021 (and referring to documents beginning with p. GTOO11542 and GTOO11547) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Chitwood, High Strength Coiled Tubing Expands Service Capabilities, served by Global Tubing, LLC on Apr. 12, 2021 (and referring to a document beginning with p. GT0023898 and ending with page GT0023913) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Crowther, served by Global Tubing, LLC on Apr. 12, 2021 (and referring to a document beginning with p. GT0012789) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 CT Manual (Supplemental), Coiled Tubing Manual, served by Global Tubing, LLC on Apr. 12, 2021 (and referring to a document beginning with p. GT0011855) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Cymax 100, served by Global Tubing, LLC on Apr. 12, 2021 in *Global Tubing, LLC* vs. *Tenaris Coiled Tubes, LLC et al.*, case No. 4:17-cv-03299 in the United States District of Texas, Houston Division, 5 pages.
Exhibit C-3 Cymax Brochure, served by Global Tubing, LLC on Apr. 12, 2021 (and referring to a document labeled with pp. TCT0009950-89) in *Global Tubing, LLC* vs. *Tenaris Coiled Tubes,*

(56) References Cited

OTHER PUBLICATIONS

*LLC et al.*, case No. 4:17-cv-03299 in the United States District Court for the Southern District of Texas, Houston Division, 5 pages.
Exhibit C-3 Eguchi 2012, served by Global Tubing, LLC on Apr. 12, 2021 (and referring to a document beginning with p. GTOO 12879) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Feng, served in Global Tubing, LLC on Apr. 12, 2021 (and referring to a document beginning with p. GT0283198) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Fujishiro, served in Global Tubing, LLC on Apr. 12, 2021 (and referring to a document beginning with p. GT0025074 and ending with p. GT0025083) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Kushida, served in Global Tubing, LLC on Apr. 12, 2021 (and referring to a document beginning with p. GT0012967) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 O'Hara, served by Global Tubing, LLC on Apr. 12, 2021 (and referring to a document beginning with p. GT0025287) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Peters, served by Global Tubing, LLC on Apr. 12, 2021 (and referring to a document beginning with p. GT0013047) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Satou, served by Global Tubing, LLC on Apr. 12, 2021 (and referring to a document beginning with p. GT0025646) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 SeaCAT 100, served by Global Tubing, LLC on Apr. 12, 2021 (and referring to documents beginning with p. TCT0374366, GT0210506, TCT0373809, TCT0372631, GT0011295, TCT0372486, TCT0375105, TCT0372730, TCT0374535) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Takeshi, served by Global Tubing, LLC on Apr. 12, 2021 (and referring to a document beginning with p. GT0025731) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Thompson, served by Global Tubing, LLC on Apr. 12, 2021 (and referring to a document labeled with pp. TCT0009930-49) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Turconi 2001, served by Global Tubing, LLC on Apr. 12, 2021 (and referring to a document beginning with p. GT0025769) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Turconi, served by Global Tubing, LLC on Apr. 12, 2021 (and referring to a document beginning with p. GT0011237) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Valdez 2010, served by Global Tubing, LLC on Apr. 12, 2021 (and referring to a document beginning with p. GTOO11261) in *Global Tubing, LLC* vs. *Tenaris Coiled Tubes, LLC et al.*, case No. 4:17-cv-03299 in the United States District Court for the Southern District of Texas, Houston Division, 5 pages.
Exhibit C-3 Williams, served by Global Tubing, LLC on Apr. 12, 2021 (and referring to a document beginning with p. GT0011295) in *Global Tubing, LLC* vs. *Tenaris Coiled Tubes*, LLC et al., case No. 4:17-cv-03299 in the United States District Court for the Southern District of Texas, Houston Division, 5 pages.
Exhibit C-3 Zemick, served by Global Tubing, LLC on Apr. 12, 2021 (and referring to a document beginning with p. GT0011300) in *Global Tubing, LLC* vs. *Tenaris Coiled Tubes, LLC et al.*, case No. 4:17-cv-03299 in the United States District Court for the Southern District of Texas, Houston Division, 5 pages.
NACE International, NACE Standard MR0175-93 Item No. 53024, "Standard Material Requirements—Sulfide Stress Cracking Resistant Metallic Materials for Oilfield Equipment", publication date unknown, served by Global Tubing, LLC on Apr. 12, 2021 as Nos. GT001413 3-GT0014160 in *Global Tubing, LLC* vs. *Tenaris Coiled Tubes, LLC et al.*, case No. 4:17-cv-03299 in the United States District Court for the Southern District of Texas, Houston Division, 28 pages.
NACE International, NACE Standard MRO 175-2003 Item No. 21302, "Standard Material Requirements—Metals for Sulfide Stress Cracking and Stress Corrosion Cracking Resistance in Sour Oilfield Environments", publication date unknown, served by Global Tubing, LLC on Apr. 12, 2021 as Nos. GT0025228-GT0025271 in *Global Tubing, LLC* vs. *Tenaris Coiled Tubes, LLC et al.*, case No. 4:17-cv-03299 in the United States District Court for the Southern District of Texas, Houston Division, 44 pages.
NACE International, NACE Standard MR0175-2002 Item No. 21304, "Standard Material Requirements—Sulfide Stress Cracking Resistant Metallic Materials for Oilfield Equipment", publication date unknown, served by Global Tubing, LLC on Apr. 12, 2021 as Nos. GT0025188-GT0025227 in *Global Tubing, LLC* vs. *Tenaris Coiled Tubes, LLC et al.*, case No. 4:17-cv-03299 in the United States District Court for the Southern District of Texas, Houston Division, 40 pages.
NACE International, NACE Standard TM0177-96 Item No. 21212, "Standard Test Method—Laboratory Testing of Vletals for Resistance to Specific Forms of Environmental Cracking in H2S Environments", publication date unknown, served by Global Tubing, LLC on Apr. 12, 2021 as Nos. GT0014098-G10014132 in *Global Tubing, LLC* vs. *Tenaris oiled Tubes, LLC et al.*, case No. 4:17-cv-03299 in the United States District Court for the Southern District of Texas, Houston Division, 35 pages.
Newman, Kenneth R, SPE163884, "Development of a New CT Life Tracking Process", SPE International, 2013, served by Global Tubing, LLC on Apr. 12, 2021 as Nos. GT0283277-GT0283288 in *Global Tubing, LLC* vs. *Tenaris Coiled Tubes, LLC et al.*, case No. 4:17-cv-03299 in the United States District Court for the Southern District of Texas, Houston Division, 12 pages.
Ogden, Becky L., "Sulfide Stress Cracking—Practical Application to the Oil and Gas Industry", 2005, served by Global Tubing, LLC on Apr. 12, 2021 as Nos. GT0025272-G10025286 in *Global Tubing, LLC* vs. *Tenaris Coiled Tubes, LLC et al.*, case No. 4:17-cv-03299 in the United States District Court for the Southern District of Texas, Houston Division, 5 pages.
Padron et al., SPE-179045-MS, "CT100+ Bias Weld Fatigue Life Estimations—Are Adjustments Required", SPE International, 2016, served by Global Tubing, LLC on Apr. 12, 2021 as Nos. GT0283314-GT0283332 in *Global Tubing, LLC* vs. *Tenaris Coiled Tubes, LLC et al.*, case No. 4:17-cv-03299 in the United States District Court for the Southern District of Texas, Houston Division, 19 pages.
Peet et al., "Fatigue of Extremely Fine Bainite", published in 2011 served by Global Tubing, LLC on Apr. 12, 2021 as Nos. GT0013042-GT0013046 in *Global Tubing, LLC* vs. *Tenaris Coiled Tubes, LLC et al.*, case No. 4:17-cv-03299 in the United States District Court for the Southern District of Texas, Houston Division, 5 pages.
Rak et al., "Weldability and Toughness Assessment of Ti-Macroalloyed Offshore Steel", published Jan. 1997, served by Global Tubing, LLC on Apr. 12, 2021 as Nos. G10013383-GT0013390 in *Global Tubing, LLC* vs. *Tenaris Coiled Tubes, LLC et al.*, case No. 4:17-cv-03299 in the United States District Court for the Southern District of Texas, Houston Division, 8 pages.

(56) References Cited

OTHER PUBLICATIONS

Revankar, Gopal, "Introduction to Hardness Testing", Mechanical Testing and Evaluation, vol. 8, ASM Handbook, revised online 2016, served by Global Tubing, LLC on Apr. 12, 2021 as Nos. GT0284430-GT0284442 in *Global Tubing,* LLC vs. *Tenaris Coiled Tubes, LLC et al.*, case No. 4:17-cv-03299 in the United States District Court for the Southern District of Texas, Houston Division, 13 pages.
Russian Office Action dated Feb. 27, 2020 for Application No. 2019124234.
Russian Office Action dated Jul. 24, 2020 for Application No. 2019124234.
SAE International, Surface Vehicle Standard J404, "Chemical Compositions of SAE Alloy Steels", Feb. 1991, served by Global Tubing, LLC on Apr. 12, 2021 as Nos. G10013066-GT0013072 in *Global Tubing, LLC* vs. *Tenaris Coiled Tubes, LLC et al.*, case No. 4:17-cv-03299 in the United States District Court for the Southern District of Texas, Houston Division, 7 pages.
Saunders et al., "Using JMatPro to Model Materials Properties and Behavior", Dec. 2003, served by Global Tubing, LLC on Apr. 12, 2021 as Nos. GT0283341-GT0283346 in *Global Tubing, LLC* vs. *Tenaris Coiled Tubes, LLC et al.*, case No. 4:17-cv-03299 in the United States District Court for the Southern District of Texas, Houston Division, 6 pages.
SeaCAT Brochure-Coiled Tubing for Subsea Umbilical and Flowline Applications, publication date unknown, produced by Tenaris Coiled Tubes, LLC as Nos. TCT0375105-TCT0375246 in *Global Tubing, LLC* vs. *Tenaris Coiled Tubes, LLC et al.*, case No. 4:17-cv-03299 in the United States District Court for the Southern District of Texas, Houston Division, 142 pages.
SeaCAT Handbook-Coiled Tubing for Subsea Umbilical and Flowline Application, published in Spring 2005, produced by Tenaris Coiled Tubes, LLC as Nos. TCT0372486-TCT0372630 in *Global Tubing, LLC* vs. *Tenaris Coiled Tubes, LLC et al.*, case No. 4:17-cv-03299 in the United States District Court for the Southern District of Texas, Houston Division, 145 pages.
SeaCAT Process Control, published in 1999, produced by Tenaris Coiled Tubes, LLC as Nos. TCT0374535-TCT0374783 in Global Tubing, LLC vs. Tenaris Coiled Tubes, LLC et al., case No. 4:17-cv-03299 in the United States District Court for the Southern District of Texas, Houston Division, 249 pages.
SeaCAT Shell Princess Project-published in Aug. 2002, produced by Tenaris Coiled Tubes, LLC as Nos. TCT0374261-TCT0374534 in *Global Tubing, LLC* vs. *Tenaris Coiled Tubes, LLC et al.*, case No. 4:17-cv-03299 in the United States District Court for the Southern District of Texas, Houston Division, 274 pages.
Seal et al., SPE 173660, "A Field Case History of Sulfate Reducing Bacteria Attack on Coiled Tubing Bias Welds—Root Causes and Remediation", SPE International, 2015, served by Global Tubing, LLC on Apr. 12, 2021 as Nos. GT0283298-GT0283313 in *Global Tubing, LLC* vs. *Tenaris Coiled Tubes, LLC et al.*, case No. 4:17-cv-03299 in the United States District Court for the Southern District of Texas, Houston Division, 16 pages.
Second Amended Answer to 57 Answer to Complaint, Counterclaim with Jury Demand, Counterclaim against Global Tubing LLC by Tenaris Coiled Tubes, LLC, filed by Global Tubing, LLC (with Attachments: #1 Exhibit A, #2 Exhibit B, #3 Exhibit C) on Aug. 13, 2019 as pleading No. 74 in case No. 4:17- cv-03299, *Global Tubing, LLC* vs. *Tenaris Coiled Tubes, LLC et al.*, in the United States District Court for the Southern District of Texas, Houston Division.
Bhadeshia, "Martensite and Bainite in Steels: Transformation Mechanism and Mechanical Properties", Jan. 1997, served by Global Tubing, LLC on Apr. 12, 2021 as Nos. GT0011578-GT0011588, in *Global Tubing, LLC* vs. *Tenaris Coiled Tubes, LLC et al.*, case No. 4:17-cv-03299 in the United States District Court for the Southern District of Texas, Houston Division, 11 pages.
Bramfitt et al., "Metallography and Microstructures of Carbon and Low-Alloy Steels", ASM Handbook, vol. 9: Metallography and Microstructures, 2004, served by Global Tubing, LLC on Apr. 12, 2021 as Nos. GT0014161-GT0014179 in *Global Tubing, LLC* vs. *Tenaris Coiled Tubes, LLC et al.*, case No. 4:17-cv-03299 in the United States District Court for the Southern District of Texas, Houston Division, 19 pages.
Brown, et al., "DEA-97 Coiled Tubing Weld Cycle Life, Joint Industry Project", Part I: Final Project Report, Oct. 26, 1995, produced by Tenaris Coiled Tubes, LLC as Nos. TCT0282964-TCT0283071 in *Global Tubing, LLC* vs. *Tenaris Coiled Tubes, LLC et al.*, case No. 4:17-cv-03299 in the United States District Court for the Southern District of Texas, Houston Division, 108 pages.
Bumer, Jr., Harold, "Hardenability of Carbon and Low-Alloy Steels", ASM Handbook, vol. 1: Properties and Selection: Irons, Steels, and High-Performance Alloys, 1990, served by Global Tubing, LLC on Apr. 12, 2021 as Nos. GT0284157-GT0284177 in *Global Tubing, LLC* vs. *Tenaris Coiled Tubes, LLC et al.*, case No. 4:17-cv-03299 in the United States District Court for the Southern District of Texas, Houston Division, 21 pages.
Caballero et al., "Influence of bainite morphology on impact toughness of continuously cooled cementite free bainitic steels", publication date unknown, served by Global Tubing, LLC on Apr. 12, 2021 as Nos. GT001159-GT0011606 in *Global Tubing, LLC* vs. *Tenaris Coiled Tubes, LLC et al.*, case No. 4:17-cv-03299 in the United States District Court for the Southern District of Texas, Houston Division, 8 pages.
Caballero et al., "The Microstructure of Continuously Cooled Tough Bainitic Steels", publication date unknown, served by Global Tubing, LLC on Apr. 12, 2021 as Nos. GT0011589-GT0011598 in *Global Tubing, LLC* vs. *Tenaris Coiled Tubes, LLC et al.*, case No. 4:17-cv-03299 in the United States District Court for the Southern District of Texas, Houston Division, 10 pages.
Campbell, F.C., "Alloy Steels", Chapter 20, Elements of Metallurgy and Engineering Alloys, first printing Jun. 2008, served by Global Tubing, LLC on Apr. 12, 2021 as Nos. GT0283864-GT0283867 in *Global Tubing, LLC* vs. *Tenaris Coiled Tubes, LLC et al.*, case No. 4:17-cv-03299 in the United States District Court for the Southern District of Texas, Houston Division, 4 pages.
Canonico, Domenic A., "Stress-Relief Heat Treating of Steel", ASM Handbook, vol. 4, Heat Treating, publication date unknown, served by Global Tubing, LLC on Apr. 12, 2021 as Nos. GT0022999-GT0023004 in *Global Tubing, LLC* vs. *Tenaris Coiled Tubes, LLC et al.*, case No. 4:17-cv-03299 in the United States District Court for the Southern District of Texas, Houston Division, 6 pages.
Cayard et al., "Serviceability of Coiled Tubing for Sour Oil and Gas Wells" 1996, served by Global Tubing, LLC on Apr. 12, 2021 as Nos. GT0013604-GT0013622 in *Global Tubing, LLC* vs. *Tenaris Coiled Tubes, LLC et al.*, case No. 4:17- cv-03299 in the United States District Court for the Southern District of Texas, Houston Division, 19 pages.
Cayard et al., "SPE 38410: Serviceability of Coiled Tubing for Sour Oil and Gas Wells", 1997, served by Global Tubing, LLC on Apr. 12, 2021 as Nos. GT0014083-GT0014097 in *Global Tubing, LLC* vs. *Tenaris Coiled Tubes, LLC et al.*, case No. 4:17-cv-03299 in the United States District Court for the Southern District of Texas, Houston Division, 15 pages.
Charbonnier et al., "Sulfide Stress Cracking of High Strength Modified Cr—Mo Steels", published May 1985, served by Global Tubing, LLC on Apr. 12, 2021 as Nos. GT0013073-GT0013082 in *Global Tubing, LLC* vs. *Tenaris Coiled Tubes, LLC et al.*, case No. 4:17-cv-03299 in the United States District Court for the Southern District of Texas, Houston Division, 10 pages.
Chen et al., "Influence of Welding on Steel Weldment Properties", ASM Handbook, vol. 6: Welding, Brazing, and Soldering, 1993, served by Global Tubing, LLC on Apr. 12, 2021 as Nos. GT0284342-GT0284354 in *Global Tubing, LLC* vs. *Tenaris Coiled Tubes, LLC et al.*, case No. 4:17-cv-03299 in the United States District Court for the Southern District of Texas, Houston Division, 13 pages.
Chinese Office Action dated Mar. 13, 2020, corresponding to Application No. 201880007203.X.
Chinese Office Action dated Mar. 2, 2021 for Application No. 201880007203.X.
Chinese Office Action dated Oct. 10, 2020 for Application No. 201880007203.X.
Chitwood et al., "OTC 7032 High-Strength Coiled Tubing Expands Service Capabilities", 1992, served by Global Tubing, LLC on Apr.

(56) References Cited

OTHER PUBLICATIONS 12, 2021 as Nos. GT0023898-GT0023913 in *Global Tubing, LLC* vs. *Tenaris Coiled Tubes, LLC et al.*, case No. 4:17-cv-03299 in the United States District Court for the Southern District of Texas, Houston Division, 16 pages.

CLI International "Final Report: Serviceability of Coiled Tubing for Sour Oil and Gas Wells", publication date unknown, served by Global Tubing, LLC on Apr. 12, 2021 as Nos. GTOO11607-GT0011796 in *Global Tubing, LLC* vs. *Tenaris Coiled Tubes, LLC et al.*, case No. 4:17-cv-03299 in the United States District Court for the Southern District of Texas, Houston Division, 190 pages.

Coloschi et al., SPE163930, "A Metallurgical Look at Coiled Tubing", SPE International, 2013, served by Global Tubing, LLC on Apr. 12, 2021 as Nos. GT0283289-GT0283297 in *Global Tubing, LLC* vs. *Tenaris Coiled Tubes, LLC et al.*, case No. 4:17-cv-03299 in the United States District Court for the Southern District of Texas, Houston Division, 9 pages.

Coulomb Status Summary Report published on Oct. 10, 2001, produced by Tenaris Coiled Tubes, LLC as Nos. TCT0372631-TCT0372667 in *Global Tubing, LLC* vs. *Tenaris Coiled Tubes, LLC et al.*case No. 4:17-cv-03299 in the United States District Court for the Southern District of Texas, Houston Division, 37 pages.

Craig, Bruce D., "Oilfield Metallurgy and Corrosion", Third Edition, published in 1993, served by Global Tubing, LLC on Apr. 12, 2021 as Nos. GT0013083-GT0013375 in *Global Tubing, LLC* vs. *Tenaris Coiled Tubes, LLC et al.*, case No. 4:17-cv-03299 in the United States District Court for the Southern District of Texas, Houston Division, 293 pages.

CTES LP, "Coiled Tubing Manual", Rev. 72005-A, 2005, served by Global Tubing, LLC on Apr. 12, 2021 as Nos. GT0011855-GT0012788 in *Global Tubing, LLC* vs. *Tenaris Coiled Tubes, LLC et al.*, case No. 4:17-cv-03299 in the United States District Court for the Southern District of Texas, Houston Division, 934 pages.

Davis J R, et al.: "ASM Specialty Handbook—Carbon and alloy steels , Passage", ASM Specialty Handbook. Carbon and Alloy Steels, XX, XX, Jan. 1, 1996 (Jan. 1, 1996), XX , pp. 12-27 + 90, XP002364757.

Davis, J.R., et al. "ASM-Speciality Handbook-Carbon and alloy steels" ASM Speciality Handbook, Carbon and Alloy Steels, 1996, pp. 12-27, XP002364757 US.

Davis, J.R., Metals Handbook—Desk Edition, Second Edition, pp. 32, 61, 1471, 1517, and 103, published in 1998, served by Global Tubing, LLC on Apr. 12, 2021 as Nos. GT0051499-GT0051506 in *Global Tubing, LLC* vs. *Tenaris Coiled Tubes, LLC et al.*, case No. 4:17-cv-03299 in the United States District Court for the Southern District of Texas, Houston Division, 8 pages.

Dupont, John N., "Fundamentals of Weld Solidification", ASM Handbook, vol. 6A, Welding Fundamentals and Processes, 2011, served by Global Tubing, LLC on Apr. 12, 2021 as Nos. GT0284358-GT0284376 in *Global Tubing, LLC* vs. *Tenaris Coiled Tubes, LLC et al.*, case No. 4:17-cv-03299 in the United States District Court for the Southern District of Texas, Houston Division, 19 pages.

Somers, Bruce R., "Introduction to the Selection of Carbon and Low-Alloy Steels", ASM Handbook, vol. 6: Welding, Brazing, and Soldering, 1993, served by Global Tubing, LLC on Apr. 12, 2021 as Nos. GT0284355-GT0284357 in *Global Tubing, LLC* vs. *Tenaris Coiled Tubes, LLC et al.*, case No. 4:17-cv-03299 in the United States District Court for the Southern District of Texas, Houston Division, 3 pages.

Southwestern Pipe, Inc, "Orbital Tig Welding, CYMAX Coiled Tubing", Nov. 1992, produced by Tenaris Coiled Tubes, LLC as Nos. TCT0009977-TCT0009989 in *Global Tubing, LLC* vs. *Tenaris Coiled Tubes, LLC et al.*, case No. 4:17- cv-03299 in the United States District Court for the Southern District of Texas, Houston Division, 13 pages.

Southwestern Pipe, Inc, "Southwestern Pipe, Inc., CYMAX Division, Coiled Tubing Specifications, Technical Data", Jan. 1, 1993, produced by Tenaris Coiled Tubes, LLC as Nos. TCT0009950-TCT0009961 in *Global Tubing, LLC* vs. *Tenaris Coiled Tubes, LLC et al.*, case No. 4:17-cv-03299 in the United States District Court for the Southern District of Texas, Houston Division, 12 pages.

Southwestern Pipe, Inc, "The Development and Testing of CYMAX 100 Coiled Tubing", Jan. 1992, produced by Tenaris Coiled Tubes, LLC as Nos. TCT0009962-TCT0009976 in *Global Tubing, LLC* vs. *Tenaris Coiled Tubes, LLC et al.*, case No. 4:17-cv-03299 in the United States District Court for the Southern District of Texas, Houston Division, 15 pages.

Thompson, J.M., "Full Body Quenched and Tempered Coiled Tubing Theory vs. Field Experience", CYMAX Division, published Mar. 1, 1994, produced by Tenaris Coiled Tubes, LLC as Nos. TCT0009930-TCT0009989 in *iGlobal Tubing, LLC* vs. *Tenaris Coiled Tubes, LLC et al.*, case No. 4:17-cv-03299 in the United States District Court for the Southern District of Texas, Houston Division, 60 pages.

Turconi, et al., "Improvement of Resistance to SCC Initiation and Propagation of High Strength OCTG Through Micro structure and Precipitation Control", Paper No. 01077, Corrosion 2001, 2001, served by Global Tubing, LLC on Apr. 12, 2021 as Nos. GT0025769-GT0025783 in *Global Tubing, LLC* vs. *Tenaris Coiled Tubes, LLC et al.*, case No. 4:17-cv-03299 in the United States District Court for the Southern District of Texas, Houston Division, 15 pages.

U.S. Pat. No. 2,586,041, issued Feb. 19, 1952, served by Global Tubing, LLC on Apr. 12, 2021 as Nos. GT0012914-GT0012915 in *Global Tubing, LLC* vs. *Tenaris Coiled Tubes, LLC et al.*, case No. 4:17-cv-03299 in the United States District Court for the Southern District of Texas, Houston Division, 2 pages.

Urayama et al., "Research and Development of Advanced Coiled-Tubing Construction and Performance", published Jun. 1, 2001, served by Global Tubing, LLC on Apr. 12, 2021 as Nos. GT0011253-GT0011260 in *Global Tubing, LLC* vs. *Tenaris Coiled Tubes, LLC et al.*, case No. 4:17-cv-03299 in the United States District Court for the Southern District of Texas, Houston Division, 8 pages.

Wang et al., "Study of High Strength Pipeline Steels with Different Microstructures", 2009, served by Global Tubing, LLC on Apr. 12, 2021 as Nos. GT0013376-GT0013382 in *Global Tubing, LLC* vs. *Tenaris Coiled Tubes, LLC et al.*, case No. 4:17-cv-03299 in the United States District Court for the Southern District of Texas, Houston Division, 7 pages.

Welding Handbook, 9th Edition, vol. 4, Materials and Applications, Part 1, published 2011, served by Global Tubing, LLC on Apr. 12, 2021 as Nos. GT0023025-GT0023884 in *Global Tubing, LLC* vs. *Tenaris Coiled Tubes, LLC et al.*, case No. 4:17-cv-03299 in the United States District Court for the Southern District of Texas, Houston Division, 860 pages.

Williams, et al., "Mensa Project: Hydraulic Umbilicals", OTC 8629, Offshore Technology Conference, 1998, served by Global Tubing, LLC on Apr. 12, 2021 as Nos. GT0011295-GT0011299 in *Global Tubing, LLC* vs. *Tenaris Coiled Tubes, LLC et al.*, case No. 4:17-cv-03299 in the United States District Court for the Southern District of Texas, Houston Division, 5 pages.

Zemick, Bill, "The Development and testing of CYMAX 100 Coiled Tubing", from "Benefits of full body quench and tempered coiled tubing", First Annual Conference on Coiled Tubing Operations & Slimhole Drilling Practices, Mar. 1-4, 1993, served by Global Tubing, LLC on Apr. 12, 2021 as Nos. GT0011300-GT0011313 in *Global Tubing, LLC* vs. *Tenaris Coiled Tubes, LLC et al.*, case No. 4:17-cv-03299 in the United States District Court for the Southern District of Texas, Houston Division, 14 pages.

Faszold et al., "Full-Scale Fatigue Testing With 130K Yield Tubing." Paper SPE-153945, Presented at SPE/ICoTA Coiled Tubing & Well Intervention Conference and Exhibition Jan. 2012, Society of Petroleum Engineers, 6 pages.

Goodall, Graeme Robertson, "Welding High Strength Modem Line Pipe Steel", 2011, served by Global Tubing, LLC on Apr. 12, 2021 as Nos. GT0013391-GT0013603 in *Global Tubing, LLC* vs. *Tenaris Coiled Tubes, LLC et al.*, case No. 4:17-cv-03299 in the United States District Court for the Southern District of Texas, Houston Division, 213 pages.

International Coiled Tubing Association, "An Introduction to Coiled Tubing", 2004, served by Global Tubing, LLC on Apr. 12, 2021 as Nos. GT0024985-GT0025016 in *Global Tubing, LLC* vs. *Tenaris*

(56) References Cited

OTHER PUBLICATIONS

*Coiled Tubes, LLC et al.*, case No. 4:17-cv-03299 in the United States District Court for the Southern District of Texas, Houston Division, 32 pages.
Johnson et al., "Toughness of Tempered Upper and Lower Bainitic Microstructures in a 4150 Steel", 1993, served by Global Tubing, LLC on Apr. 12, 2021 as Nos. GT0012916-GT0012924 in *Global Tubing, LLC* vs. *Tenaris Coiled Tubes, LLC et al.*, case No. 4:17-cv-03299 in the United States District Court for the Southern District of Texas, Houston Division, 9 pages.
Kirkaldy, U.S., "Quantitative Prediction of Transformation Hardening in Steels", ASM Handbook, vol. 4, Heat Treating, published in 1991, served by Global Tubing, LLC on Apr. 12, 2021 as Nos. GT0022924-GT0022940 in *Global Tubing, LLC* vs. *Tenaris Coiled Tubes, LLC et al.*, case No. 4:17-cv-03299 in the United States District Court for the Southern District of Texas, Houston Division, 17 pages.
Korean Office Action dated Mar. 23, 2021, for Korean Patent Application No. 10-2019-702389.
Kraus, George, "Microstructures, Processing, and Properties of Steels", ASM Handbook, vol. 1: Properties and Selection: Irons, Steels, and High-Performance Alloys, 1990, served by Global Tubing, LLC on Apr. 12, 2021 as Nos. GT0284213-GT0284226 in *Global Tubing, LLC* vs. *Tenaris Coiled Tubes, LLC et al.*, case No. 4:17-cv-03299 in the United States District Court for the Southern District of Texas, Houston Division, 14 pages.
Andes, JohnD., "Fracture Toughness Testing", ASM Handbook, vol. 19: Fatigue and Fracture, 1996, served by Global Tubing, LLC on Apr. 12, 2021 as Nos. GT0284279-GT0284295 in *Global Tubing, LLC* vs. *Tenaris Coiled Tubes, LLC et al.*, case No. 4:17-cv-03299 in the United States District Court for the Southern District of Texas, Houston Division, 17 pages.
Awrynowicz et al., "Features of Bainite Transformation in Steels", published Nov. 2002, served by Global Tubing, LLC on Apr. 12, 2021 as Nos. GT0012978-GT0013005 in *Global Tubing, LLC* vs. *Tenaris Coiled Tubes, LLC et al.*, case No. 4:17-cv-03299 in the United States District Court for the Southern District of Texas, Houston Division, 28 pages.
Liu et al., "Weldability of Steels", ASM Handbook vol. 1: Properties and Selection: Irons, Steels, and High-Performance Alloys, 1990, served by Global Tubing, LLC on Apr. 12, 2021 as Nos. GT0284227-GT0284237 in *Global Tubing, LLC* vs. *Tenaris Coiled Tubes, LLC et al.*, case No. 4:17-cv-03299 in the United States District Court for the Southern District of Texas, Houston Division, 11 pages.
Maalekian, Mehran, "Solid-State Transformations in Weldments", ASM Handbook, vol. 6A, Welding Fundamentals and Processes, 2011, served by Global Tubing, LLC on Apr. 12, 2021 as Nos. GT0284377-GT0284400 in *Global Tubing, LLC* vs. *Tenaris Coiled Tubes, LLC et al.*, case No. 4:17-cv-03299 in the United States District Court for the Southern District of Texas, Houston Division, 24 pages.
Maurer Engineering Inc., "Coiled-Tubing Technology (1995-1998)", Apr. 1998, served by Global Tubing, LLC on Apr. 12, 2021 as Nos. GT0013623-GT0014082 in *Global Tubing, LLC* vs. *Tenaris Coiled Tubes, LLC et al.*, case No. 4:17-cv-03299 in the United States District Court for the Southern District of Texas, Houston Division, 460 pages.
"Fracture Mechanics Properties of Carbon and Alloy Steels", ASM Handbook, vol. 19: Fatigue and Fracture, 1996, served by Global Tubing, LLC on Apr. 12, 2021 as No. GT0284238-GT0284278 in *Global Tubing, LLC* vs. *Tenaris Coiled Tubes, LLC et al.*, case No. 4:17-cv-03299 in the United States District Court for the Southern District of Texas, Houston Division, 41 pages.
"Fracture Toughness and Fracture Mechanics", ASM Handbook, vol. 8: Mechanical Testing and Evaluation, 2000, served by Global Tubing, LLC on Apr. 12, 2021 as Nos. GT0284401-GT0284413 in *Global Tubing, LLC* vs. *Tenaris Coiled Tubes, LLC et al.*, case No. 4:17-cv-03299 in the United States District Court for the Southern District of Texas, Houston Division, 13 pages.
"High-Strength Structural and High-Strength Low-Alloy Steels", ASM Handbook, vol. 1: Properties and Selection: Irons, Steels, and High-Performance Alloys, 1990, served by Global Tubing, LLC on Apr. 12, 2021 as Nos. GT0284178- GT0284212 in *Global Tubing, LLC* vs. *Tenaris Coiled Tubes, LLC et al.*, case No. 4:17-cv-03299 in the United States District Court for the Southern District of Texas, Houston Division, 35 pages.
"Impact Toughness Testing", ASM Handbook, vol. 8: Mechanical Testing and Evaluation, 2000, served by Global Tubing, LLC on Apr. 12, 2021 as Nos. GT0284414-GT0284429 in *Global Tubing, LLC* vs. *Tenaris Coiled Tubes, LLC et al.*, case No. 4:17-cv-03299 in the United States District Court for the Southern District of Texas, Houston Division, 16 pages.
"Introduction to Steel Heat Treatment", ASM Handbook, vol. 4A, Steel Heat Treating Fundamentals and Processes, 2013, served by Global Tubing, LLC on Apr. 12, 2021 as Nos. GT0284319-GT0284341 in *Global Tubing, LLC* vs. *Tenaris Coiled Tubes, LLC et al.*, case No. 4:17-cv-03299 in the United States District Court for the Southern District of Texas, Houston Division, 23 pages.
"Martensitic Structures", ASM Handbook, vol. 9: Metallography and Microstructures, 2004, served by Global Tubing, LLC on Apr. 12, 2021 as Nos. GT0284443-GT0284456 in *Global Tubing, LLC* vs. *Tenaris Coiled Tubes, LLC et al.*, case No. 4:17-cv-03299 in the United States District Court for the Southern District of Texas, Houston Division, 14 pages.
"SeaCAT LP—Specification for SeaCAT 100 Umbilical Tubing Continuous Anode Technology", <http://seacatcorp.com/ SeaCat 100 Tubing spec Rev 5 Jul. 1, 2003.htm>, dated Nov. 14, 2004, served by Global Tubing, LLC on Apr. 12, 2021 as Nos. GT0210506-GT0210510 in *Global Tubing, LLC* vs. *Tenaris Coiled Tubes, LLC et al.*, case No. 4:17- cv-03299 in the United States District Court for the Southern District of Texas, Houston Division, 5 pages.
"Software for Computational Materials Modeling and Simulation", ASM Handbook, vol. 22B, Metals Process Simulation, 2010, served by Global Tubing, LLC on Apr. 12, 2021 as Nos. GT0284311-GT0284318 in *Global Tubing, LLC* vs. *Tenaris Coiled Tubes, LLC et al.*, case No. 4:17-cv-03299 in the United States District Court for the Southern District of Texas, Houston Division, 8 pages.
"Southwestern Pipe Inc., Specification for Cymax 80 High Strength Low Alloy Steel Coiled Tubing for Sour Environment Service," Date of publication unknown, but presumably prior to the earliest claimed priority date for the bending application; document bears the date Sep. 1, 1993, 2 pages (28-29) of the 60 page composite document submitted herewith as Desig. ID 4,.
"Specification for Coiled Tubing—U.S. Customary and SI Units", API Specification 5ST, First Edition, Apr. 2010, served by Global Tubing, LLC on Apr. 12, 2021 as Nos. GT0224055-GT0224129 in *Global Tubing, LLC* vs. *Tenaris Coiled Tubes, LLC et al.*, case No. 4:17-cv-03299 in the United States District Court for the Southern District of Texas, Houston Division, 75 pages.
Adams et al., SPE 29456, "An Evaluation of Large Diameter Coiled Tubing for Subsurface Production Tubulars", SPE International, 1995, served by Global Tubing, LLC on Apr. 12, 2021 as Nos. GT0284484-GT0284489 in *Global Tubing, LLC* vs. *Tenaris Coiled Tubes, LLC et al.*, case No. 4:17-cv-03299 in the United States District Court for the Southern District of Texas, Houston Division, 6 pages.
Afghoul et al., "Coiled Tubing: The Next Generation", published in 2004, served by Global Tubing, LLC on Apr. 12, 2021 as Nos. GT0011405-GTOO11424, in *Global Tubing, LLC* vs. *Tenaris Coiled Tubes, LLC et al.*, case No. 4:17- cv-03299 in the United States District Court for the Southern District of Texas, Houston Division, 20 pages.
Aliya, Debbie, "Physical Metallurgy Concepts in Interpretation of Microstructures", ASM Handbook, vol. 9: Metallography and Microstructures, 2004, served by Global Tubing, LLC on Apr. 12, 2021 as Nos. GT0284457-GT0284483 in *Global Tubing, LLC* vs. *Tenaris Coiled Tubes, LLC et al.*, case No. 4:17-cv-03299 in the United States District Court for the Southern District of Texas, Houston Division, 27 pages.
Antolovich, Stephen D., "Alloy Design for Fatigue and Fracture", ASM Handbook, vol. 19: Fatigue and Fracture, 1996, served by Global Tubing, LLC on Apr. 12, 2021 as Nos. GT0284296-

(56) References Cited

OTHER PUBLICATIONS

GT0284310 in *Global Tubing, LLC* vs. *Tenaris Coiled Tubes, LLC et al.*, case No. 4:17-cv-03299 in the United States District Court for the Southern District of Texas, Houston Division, 15 pages.
API Specification 5L, Specification for Line Pipe, 45th Edition, Jul. 2013, served by Global Tubing, LLC on Apr. 12, 2021 as Nos. GT0283868-GT0284059 in *Global Tubing, LLC* vs. *Tenaris Coiled Tubes, LLC et al.*, case No. 4:17- cv-03299 in the United States District Court for the Southern District of Texas, Houston Division, 192 pages.
API Specification, "ISO 11960:2011 Petroleum and Natural Gas Industries—Steel Pipes for Use as Casing or Tubing for Wells", published Jun. 2011, served by Global Tubing, LLC on Apr. 12, 2021 as Nos. GT0011314-GT0011404 in *Global Tubing, LLC* vs. *Tenaris Coiled Tubes, LLC et al.*, case No. 4:17-cv-03299 in the United States District Court for the Southern District of Texas, Houston Division, 91 pages.
Arai, et al., ASM Handbook, vol. 4—Heat Treating, 1994, served by Global Tubing, LLC on Apr. 12, 2021 as Nos. GT0130869-GT0131868 in *Global Tubing, LLC* vs. *Tenaris Coiled Tubes, LLC et al.*, case No. 4:17-cv-03299 in the United States District Court for the Southern District of Texas, Houston Division, 1000 pages.
ASM International, Practical Heat Treating, Second Edition (#05144G), "Chapter 2—Fundamentals of the Heat Treating of Steel", 2006, served by Global Tubing, LLC on Apr. 12, 2021 as Nos. GT0035357-GT0035374 in *Global Tubing, LLC* vs. *Tenaris Coiled Tubes, LLC et al.*, case No. 4:17-cv-03299 in the United States District Court for the Southern District of Texas, Houston Division, 18 pages.
ASTM Designation: A 606-75, "American Society for Testing and Materials" American National Standards Institute , publication date unknown, served by Global Tubing, LLC on Apr. 12, 2021 as Nos. GT0011556-GT0011559, in *Global Tubing, LLC* vs. *Tenaris Coiled Tubes, LLC et al.*, case No. 4:17-cv-03299 in the United States District Court for the Southern District of Texas, Houston Division, 4 pages.
ASTM Designation: A 607-75 (Reapproved 1981), Standard Specification for Steel Sheet and Strip, Hot-Rolled and Cold-Rolled, High-Strength, Low-Alloy Columbium and/or Vanadium, publication date unknown, served by Global Tubing, LLC on Apr. 12, 2021 as Nos. GT0011560-GT0011563 in *Global Tubing, LLC* vs. *Tenaris Coiled Tubes, LLC et al.*, case No. 4:17-cv-03299 in the United States District Court for the Southern District of Texas, Houston Division, 4 pages.
ASTM Designation: A 715-81, Standard Specification for Steel Sheet and Strip, Hot-Rolled and Cold-Rolled, High-Strength, Low-Alloy with Improved Formability, publication date unknown, served by Global Tubing, LLC on Apr. 12, 2021 as Nos. GT0011564-GT0011567, in *Global Tubing, LLC* vs. *Tenaris Coiled Tubes, LLC et al.*, case No. 4:17-cv-03299 in the United States District Court for the Southern District of Texas, Houston Division, 4 pages.
ASTM International, Designation A 255-02, "Standard Test Methods for Determining Hardenability of Steel", publication date unknown, served by Global Tubing, LLC on Apr. 12, 2021 as Nos. GT0283245-GT0283268 in *Global Tubing, LLC* vs. *Tenaris Coiled Tubes, LLC et al.*, case No. 4:17-cv-03299 in the United States District Court for the Southern District of Texas, Houston Division, 24 pages.
ASTM International, Designation: EI 12-12, "Standard Test Methods for Determining Average Grain Size", publication date unknown, served by Global Tubing, LLC on Apr. 12, 2021 as Nos. GT0284060-GT0284086 in *Global Tubing, LLC* vs. *Tenaris Coiled Tubes, LLC et al.*, case No. 4:17-cv-03299 in the United States District Court for the Southern District of Texas, Houston Division, 27 pages.
Auguston, Rogerio "The Influence of Chemical Composition and Microstructure of API Linepipe Steels on Hydrogen Induced Cracking and Sulfide Stress Corrosion Cracking", Materials Science and Engineering, published in 2003, produced by Tenaris Coiled Tubes, LLC as Nos. TCT0152051-TCT0152057 in *Global Tubing, LLC* vs. *Tenaris Coiled Tubes, LLC et al.*, case No. 4:17-cv-03299 in the United States District Court for the Southern District of Texas, Houston Division, 7 pages.
Babu et al., "Effect of Austenitizing Temperature and Cooling Rate on the Structure and Properties of a Ultrahigh Strength Low Alloy Steel", 2006, served by Global Tubing, LLC on Apr. 12, 2021 as Nos. GT0011568-GT0011577, in *Global Tubing, LLC* vs. *Tenaris Coiled Tubes, LLC et al.*, case No. 4:17-cv-03299 in the United States District Court for the Southern District of Texas, Houston Division, 10 pages.
Bates, et al., "Quenching of Steel", ASM Handbook, vol. 4, Heat Treating, published in 1993, served by Global Tubing, LLC on Apr. 12, 2021 as Nos. GT0022941-GT0022998 in *Global Tubing, LLC* vs. *Tenaris Coiled Tubes, LLC et al.*, case No. 4:17-cv-03299 in the United States District Court for the Southern District of Texas, Houston Division, 58 pages.
Chinese Office Action dated Jul. 4, 2023 for Chinese Patent Application No. 2021111057037.

* cited by examiner

METHOD OF MANUFACTURING A COILED TUBING STRING

CROSS-REFERENCE TO RELATED APPLICATIONS

This application is a continuation of and claims priority to U.S. patent application Ser. No. 15/407,855, filed on Jan. 17, 2017, the contents of which are hereby incorporated by reference.

BACKGROUND

Field

The disclosure relates to a method of manufacturing a coiled tubing string.

Description of the Related Art

Coiled tubing strings are used in many applications in the oil and gas industry. The tubing string is formed from flat metal strips that are joined end to end into a flat metal sheet and coiled onto an accumulator. The flat metal sheet is generally uncoiled from the accumulator, bent into tubular form, and welded along the seam to produce a string of tubing. The tubing string is then coiled onto a spool.

Typically, the coiled tubing string is moved to another location and uncoiled from the spool for additional treatment, such as heating, quenching, and tempering to attain specified material properties. Subsequent to the additional treatment, the tubing string is re-coiled onto another spool and transported to another location for additional testing before use in an oil and gas operation. The uncoiling, moving, and re-coiling of the tubing string adds time and expense to the process of manufacturing the tubing string.

Therefore, there is a need for an improved method of manufacturing a coiled tubing string.

SUMMARY

In one embodiment, a method of manufacturing a coiled tubing string comprises uncoiling a flat metal sheet from an accumulator; bending the flat metal sheet that is uncoiled from the accumulator into a tubular form such that the edges of the flat metal sheet form a seam along a longitudinal length of the tubular form; welding the seam formed along the longitudinal length to form a tubing string; and coiling the tubing string onto a spool, wherein the tubing string is heat treated to meet specified material properties in a continuous operation from the accumulator to the spool.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
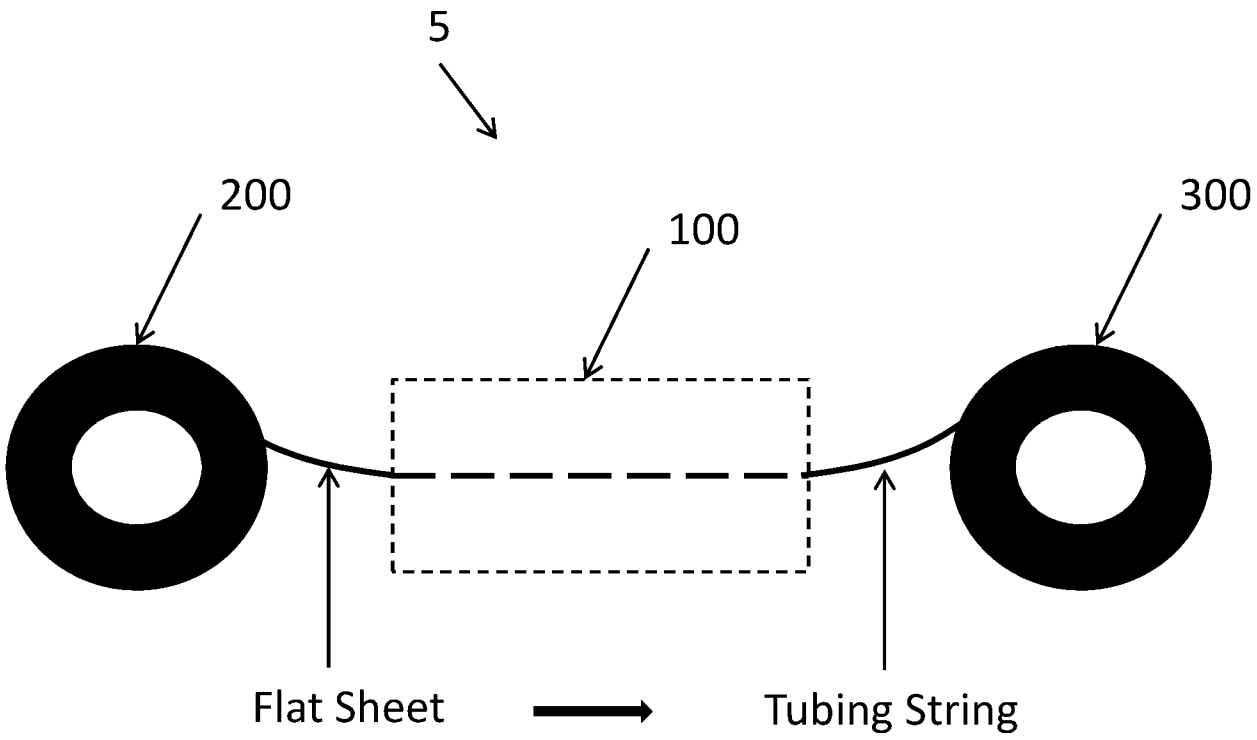
FIG. 1 is a schematic illustration of a coiled tubing string operation, according to one embodiment.

FIG. 1 is a schematic illustration of a coiled tubing string operation 5, according to one embodiment. The operation 5 includes uncoiling a flat sheet of metal from an accumulator 200, feeding the flat sheet through a method 100 of manufacturing a coiled tubing string, and coiling the formed tubing string onto a spool 300, all in a single continuous operation to meet specified material properties. Although additional testing, inspection, and installation may occur after the tubing string is spooled onto the spool 300, the tubing string will be manufactured to meet specified material properties upon being coiled onto the spool 300.

The specified material properties may include, but are not limited to, physical properties, mechanical properties, and structural properties. The physical properties may include, but are not limited to, dimensions (such as length, inner/outer diameter size, and wall thickness), surface quality (such as smoothness), and roundness. The mechanical properties may include but are not limited to, yield strength, tensile strength, elongation, elastic modulus, toughness, fracture toughness, hardness, fatigue life, fatigue strength, ductility. The structural properties may include, but are not limited to grain size, corrosion resistance, microstructure, and composition.

The operation 5 has an increased output and is more efficient than other coiled tubing string heat treatment operations, which require uncoiling, re-coiling, and moving of the tubing string multiple times and to multiple locations for additional treatments, such as heat treatments, to meet specified material properties. The tubing string formed according to the method 100 described herein is fully formed and treated in a complete, continuous operation, starting from the uncoiling of the flat sheet of metal from the accumulator 200, and ending with the coiling of the tubing string onto the spool 300, fully meeting specified material properties. The tubing string formed according to the method 100 described herein does not require uncoiling, re-straightening, or moving of the tubing string from the spool 300 for additional treatments to meet specified material properties. The speed at which the tubing string is formed, treated, and/or coiled can be controlled, e.g. increased or decreased, throughout the entire operation 5.

Figure 2:
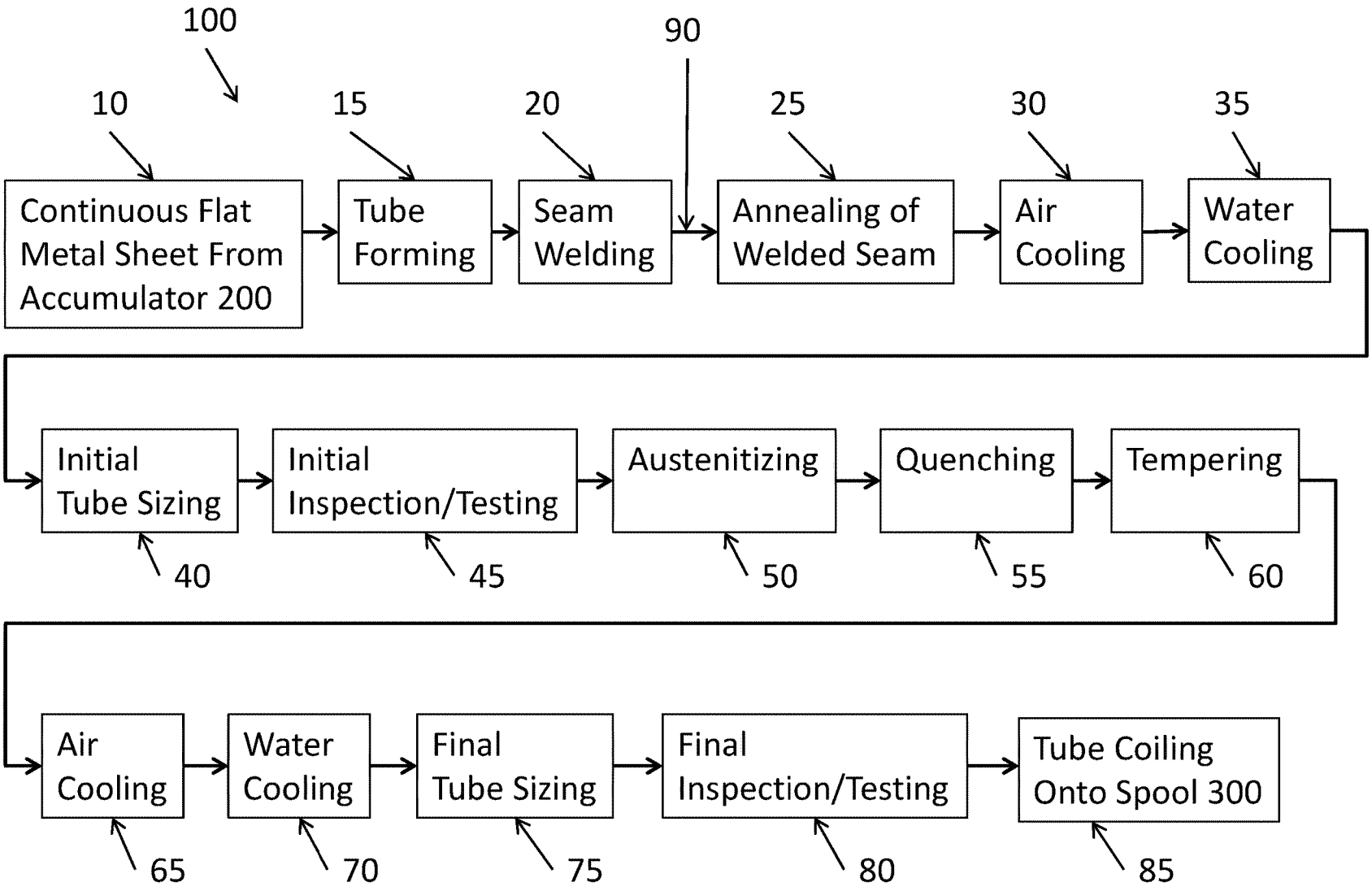
FIG. 2 is a schematic illustration of a method of manufacturing a coiled tubing string, according to one embodiment.

FIG. 2 schematically illustrates the method 100 of manufacturing a coiled tubing string in a continuous operation, beginning with a continuous flat metal sheet 10 and ending with a tubing string coiled onto a spool 300 (shown in FIG. 1). The flat metal sheet 10 may be pre-coiled onto the accumulator 200. The flat metal sheet 10 may comprise wrought iron or steel.

The flat metal sheet 10 is continuously fed from the accumulator 200 into the tube forming operation 15. In the tube forming operation 15, the flat metal sheet 10 is bent into a tubular form such that a longitudinal seam is formed along the longitudinal length by the edges of the flat metal sheet 10 that are brought together. The flat metal sheet 10 may be bent into the tubular form using one or more tube formers as known in the art.

From the tube forming operation 15, the flat metal sheet 10 is continuously fed into a seam welding operation 20. In the seam welding operation 20, the flat metal sheet 10 that has been bent into a tubular form is welded along the seam to form a tubing string 90. The seam may be welded using a high frequency induction welding process and/or other welding processes as known in the art.

After the seam welding operation 20, the tubing string 90 is sent through a seam annealing operation 25, an air cooling operation 30, and/or a water cooling operation 35, collectively referred to as an initial cooling operation. In particular, the tubing string 90 is annealed along the seam weld, then air cooled, and/or then water cooled to ambient temperature.

In the seam annealing operation 25, for example, the welded seam is quickly heated (such as by induction heating to a temperature of about 955 degrees Celsius) to reduce hardness, refine grain size, and increase ductility of the welded seam. In the air cooling operation 30 and/or the water cooling operation 35, for example, the tubing string 90 is slowly cooled entirely or at least partially by air and/or water to bring down the temperature of the tubing string 90 to ambient temperature for initial tube sizing and/or inspection/testing operations. The initial cooling operation may include any number of air cooling and/or water cooling operations.

After the initial cooling operation, an initial tube sizing operation 40 is conducted. The tubing string 90 progresses through the initial tube sizing operation 40 where one or more sizing rollers form the preliminary outside diameter of the tubing string 90. For example, the one or more rollers (incrementally) reduce the outer diameter of the tubing string 90 from a larger outer diameter to a smaller nominal outer diameter. After the initial tube sizing operation 40, the tubing string 90 undergoes an initial inspection/testing operation 45 where one or more non-destructive tests are conducted on the tubing string 90 to verify that the specified material properties and weld seam quality of the tubing string 90 have been attained.

From the initial inspection/testing operation 45, the tubing string 90 is sent through an austenitizing operation 50, a quenching operation 55, and/or a tempering operation 60, collectively referred to as a heat treatment operation. In particular, the tubing string 90 is treated, e.g. repeatedly heated and/or cooled, by the heat treatment operation to attain specified material properties, such as by changing the microstructure of the tubing string 90.

In the austenitizing operation 50, for example, the tubing string 90 is heated to a temperature within a range of about 850 degrees Celsius to about 1,050 degrees Celsius to change the microstructure of the tubing string 90 to austenite. In the quenching operation 55, for example, the tubing string 90 is rapidly cooled by water to form martensite and increase the hardness and strength of the tubing string 90. In the tempering operation 60, for example, the tubing string 90 is heated again to decrease some of the hardness of the tubing string 90 attained during the quenching operation 55 and form a tempered martensite microstructure. The heat treatment operation may include any number of austenitizing, quenching, and/or tempering operations.

After the heat treatment operations, the tubing string 90 is sent through another air cooling operation 65 and/or another water cooling operation 70, collectively referred to as a final cooling operation. In particular, the tubing string 90 is air cooled and then water cooled to ambient temperature. In the air cooling operation 65 and/or the water cooling operation 70, for example, the tubing string 90 is slowly cooled by air and/or water to bring down the temperature of the tubing string 90 for final tube sizing, inspection/testing, and/or coiling operations. The final cooling operation may include any number of air cooling and/or water cooling operations.

From the final cooling operation, the tubing string 90 is continuously fed into a final tube sizing operation 75 to conduct final tube sizing. In the final tube sizing operation 75, the outer diameter of the tubing string 90 is refined to a desired outer diameter. For example, the outer diameter of the tubing string 90 may be reduced (in one or more stages by one or more series of sizing rollers) during the final tube sizing operation 75. The tubing string 90 may be sized to have a substantially uniform outer diameter, a substantially uniform inner diameter, and/or a substantially uniform wall thickness. After the final tube sizing operation 75, the tubing string 90 undergoes a final inspection/testing operation 80 where one or more non-destructive tests are conducted on the tubing string 90 to verify that the specified material properties and weld seam quality of the tubing string 90 have been attained.

From the final inspection/testing operation 80, the tubing string 90 is continuously fed into a tube coiling operation 85. In the tube coiling operation 85, the tubing string 90 is continuously coiled onto a spool, such as the spool 300 illustrated in FIG. 1. The tubing string 90 has met all specified material properties and weld seam quality upon being coiled onto the spool 300.

The method 100 is not limited to the sequence or number of operations illustrated in FIG. 2, but may include other embodiments that include re-ordering, repeating, adding, and/or removing one or more of the operations 15, 20, 25, 30, 35, 40, 45, 50, 55, 60, 65, 70, 75, 80, and/or 85.

The specified material properties of the tubing string 90 formed by the method 100 may be substantially uniform across substantially the entire length of the tubing string 90 but may vary within normal tolerance ranges.

In one embodiment, a tubing string having a length within a range of about 10,000 feet to about 30,000 feet may be formed using the method 100 described herein. In one embodiment, a tubing string having an outer diameter within a range of about 1.5 inches to about 5.5 inches may be formed using the method 100 described herein. In one embodiment, a tubing string having an inner diameter within a range of about 1 inch to about 5 inches may be formed using the method 100 described herein. In one embodiment, a tubing string having at least one of an outer diameter and an inner diameter within a range of about 1 inch to about 5.5 inches may be formed using the method 100 described herein.

In one embodiment, a tubing string having a yield strength within a range of about 80,000 psi to about 165,000 psi may be formed using the method 100 described herein. In one embodiment, a tubing string having a tensile strength within a range of about 90,000 psi to about 190,000 psi may be formed using the method 100 described herein. In one embodiment, a tubing string having a hardness within a range of about 18 Rockwell HRC to about 40 Rockwell HRC may be formed using the method 100 described herein.

It will be appreciated to those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within scope of the disclosure. It is therefore intended that the following appended claims may include all such modifications, permutations, enhancements, equivalents, and improvements.

I claim:

1. A method of manufacturing a coiled tubing string, comprising:

uncoiling a flat metal sheet from an accumulator;

bending the flat metal sheet that is uncoiled from the accumulator into a tubular form such that edges of the flat metal sheet form a seam along a longitudinal length of the tubular form;

welding the seam formed along the longitudinal length to form a tubing string;

austenitizing the tubing string and then quenching the tubing string;

conducting at least one sizing operation to reduce an outer diameter of the tubing string;

conducting at least one inspection and testing operation;

tempering and then cooling the tubing string, wherein a temperature at which the tubing string is tempered is less than a temperature at which the tubing string is austenitized; and coiling the tubing string onto a spool, wherein the method is performed in a continuous operation from the accumulator to the spool.

2. The method of claim 1, further comprising annealing the welded seam at a first temperature and then cooling the tubing string.

3. The method of claim 2, wherein a temperature at which the welded seam is annealed is less than the temperature at which the tubing string is austenitized.

4. The method of claim 2, wherein the welded seam is annealed at a temperature of 955 degrees Celsius.

5. The method of claim 2, wherein cooling the tubing string after annealing the welded seam comprises air cooling and/or water cooling the tubing string.

6. The method of claim 1, wherein the tubing is austenitized at a temperature of 850 degrees Celsius to 1,050 degrees Celsius.

7. The method of claim 1, wherein the seam is welded together by induction welding and/or other welding processes.

8. The method of claim 1, wherein cooling the tubing string after tempering comprises air cooling and/or water cooling the tubing string.

9. The method of claim 1, further comprising wherein the at least one inspection and testing operation of the tubing string is conducted after the at least one sizing operation.

10. The method of claim 1, wherein the tubing string when coiled onto the spool has one or more material properties that are substantially uniform across substantially the entire longitudinal length of the tubing string.

11. The method of claim 10, wherein the one or more material properties include at least one of dimension, surface quality, roundness, yield strength, tensile strength, elongation, elastic modulus, toughness, fracture toughness, hardness, fatigue life, fatigue strength, ductility, grain size, corrosion resistance, microstructure, or composition.

12. The method of claim 1, wherein the tubing string when coiled onto the spool has a yield strength within a range of 80,000 psi to 165,000 psi.

13. The method of claim 1, wherein the tubing string when coiled onto the spool has a tensile strength within a range of 90,000 psi to 190,000 psi.

14. The method of claim 1, wherein the tubing string when coiled onto the spool has a hardness within a range of 18 Rockwell HRC to 40 Rockwell HRC.

15. The method of claim 1, wherein the tubing string when coiled onto the spool has an outer diameter within a range of 1.5 inches to 5.5 inches.

16. The method of claim 1, wherein the longitudinal length of the tubing string coiled onto the spool is within a range of 10,000 feet to 30,000 feet.

* * * * *